United States Patent [19]

Itaya

[11] Patent Number: 4,991,277

[45] Date of Patent: Feb. 12, 1991

[54] SYSTEM FOR MANUFACTURING SPRINGS

[75] Inventor: Reijiro Itaya, Tokyo, Japan

[73] Assignee: Kabushiki Kaisha Itaya Seisaku Sho, Tokyo, Japan

[21] Appl. No.: 442,417

[22] Filed: Nov. 22, 1989

Related U.S. Application Data

[63] Continuation of Ser. No. 150,974, Feb. 1, 1988, abandoned.

[30] Foreign Application Priority Data

Feb. 20, 1987 [JP] Japan ..... 62-35840

[51] Int. Cl.[5] ..... B21F 35/00

[52] U.S. Cl. ..... 29/173; 72/138

[58] Field of Search ..... 29/173; 72/129, 131, 72/132, 138

[56] References Cited

U.S. PATENT DOCUMENTS 3,610,006 10/1971 Scheublein, Jr. et al. ..... 72/22
3,906,766 9/1975 Sato .
4,112,721 9/1978 Takase et al. ..... 72/138

OTHER PUBLICATIONS

German Magazine Draht, 1984, No. 1, pp. 19, 20.
German Magazine Draht, 1982, No. 9, p. 582.
German Magazine Draht, 1982, No. 5, p. 301.
German Magazine Draht, 1980, No. 1, p. 44.

*Primary Examiner*—P. W. Echols
*Attorney, Agent, or Firm*—Frishauf, Holtz, Goodman & Woodward

[57] ABSTRACT

Springs manufactured to have a desired free length nonetheless exhibit a slight difference in free length from one spring to another. This results from a change in elasticity caused by a difference in wire material or a non-uniformity in wire cross section from one lot of wire to another or within one and the same lot. A plurality of pre-manufacturing operations, respectively, produce a given number of test springs is used to determine an optimum value of a control variable which is then used in a manufacturing operation. In a pre-manufacturing operation, the difference between the desired free length and the actual free length is determined, and the amount of this difference is multiplied by the control variable to produce a feedback signal. The feedback signal determined for one spring is used to adjust the thrusting motion of a pitch tool for corresponding by adjusting the free length of a subsequent spring. Each pre-manufacturing operation is performed with a different value of the control variable. The optimum value is determined from a distribution based on the actual free lengths associated with each value thereof.

8 Claims, 11 Drawing Sheets

SYSTEM FOR MANUFACTURING SPRINGS

This application is a continuation of application Ser. No. 150,974, filed Feb. 1, 1988, now abandoned.

BACKGROUND OF THE INVENTION

This invention relates to a system for manufacturing springs of any prescribed free length, and to a method of manufacturing such springs When manufacturing springs using a system of the aforementioned type in the prior art, the general practice is to manufacture the springs upon setting parameters related to spring manufacture. Even when various parameter data concerning spring manufacture have been set, however, springs having the same free length do not always result, so that there is usually a certain degree of variance from one spring to another.

The reasons for the above primarily are a change in the wire material, wire characteristics such as a non-uniformity in the cross-sectional shape (diameter, etc.) thereof, and a change in the environment, such as a change in temperature, at the time of manufacture. In particular, a change in wire characteristics owing to a difference among wire lots is a matter of course, but there are also slight variations among the wires in one and the same lot.

When there is a change in the wire characteristics or a change in temperature, this is ultimately accompanied by a change in the elasticity of the wire. By way of example, even when a spring is manufactured by moving a swivel shaft in the axial direction while forcibly winding a wire on the swivel shaft, the wire attempts to return to its original shape to a slight degree owing to its elasticity. As a result, a spring having the pitch and number of turns that prevailed at winding cannot be manufactured. Accordingly, when it is considered that the elasticity of a wire is constantly changing when a spring is being manufactured, it can be understood how difficult it is to manufacture springs having a fixed, free length.

Let springs which fall within allowable limits with regard to their desired free length be defined as "acceptable" or "non-defective" springs. In spring manufacture, what is important is to develop an expedient for raising the acceptance rate or yield, namely the ratio of the number of non-defective springs to the total number of springs manufactured In the prior art, however, there are many aspects in which reliance is placed upon the intuition or skill of the worker in an attempt to achieve this, and a firm set of relevant techniques has not yet been established.

SUMMARY OF THE INVENTION

An object of the present invention is to provide a spring manufacturing system in which springs having a desired free length can be manufactured in large quantities through a simple operation.

According to the present invention, the foregoing object is attained by providing a spring manufacturing system comprising: feeding means for feeding a wire, a coiling point means situated in the direction of feed for being contacted by the wire to forcibly bend the wire in a predetermined direction, a pitch tool means reciprocating in a direction substantially perpendicular to a plane in which the wire is being bent for thrusting into contact with the wire to form pitch in the wire as the wire is being bent continuously by the coiling point means, severing means for severing the wire in synchronization with the reciprocating motion of the pitch tool means, setting means for setting a desired free length of a manufactured spring by selecting one of a plurality of values of a controlled variable to set a corresponding amount of thrusting motion of the pitch tool means detecting means for detecting the amount of a difference between the actual free length of a manufactured spring and the desired free length, means for converting the detected amount of difference into an amount of feedback, adjusting means for adjusting an amount of the thrusting motion of pitch tool means in accordance with the amount of feedback output from the converting means, means for manufacturing a predetermined number of springs in a manufacturing operation performed for each of a plurality of values of a control variable, and analyzing means for identifying an optimum one of said plurality of control variables in accordance with a distribution of free lengths of the springs manufactured on the basis of each control variable. The meaning of the term "control variable" as used herein applies only to the coefficient C. The difference between the desired free length and the actual free length is multiplied by this coefficient, whose value is selectively varied, and the result is used for adjustment of the amount of thrust of the pitch tool, as will be evident from the following description of the invention.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

An embodiment of the present invention will now be described in detail with reference to the accompanying drawings.

Figure 1:
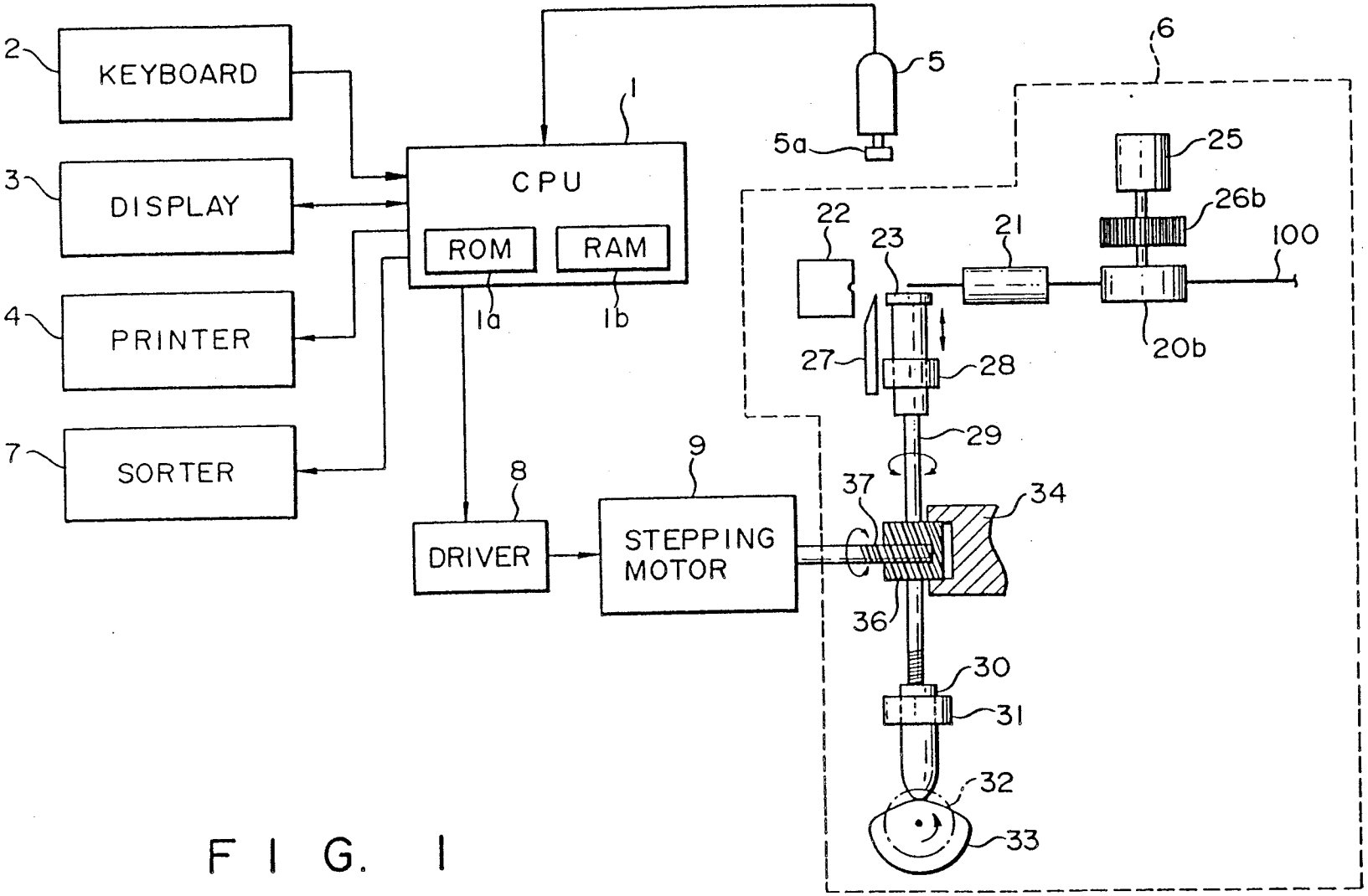
FIG. 1 is a block diagram of a spring manufacturing system embodying the present invention.

FIG. 1 is a block diagram showing the construction of a spring manufacturing system according to the embodiment of the invention.

Figure 3:
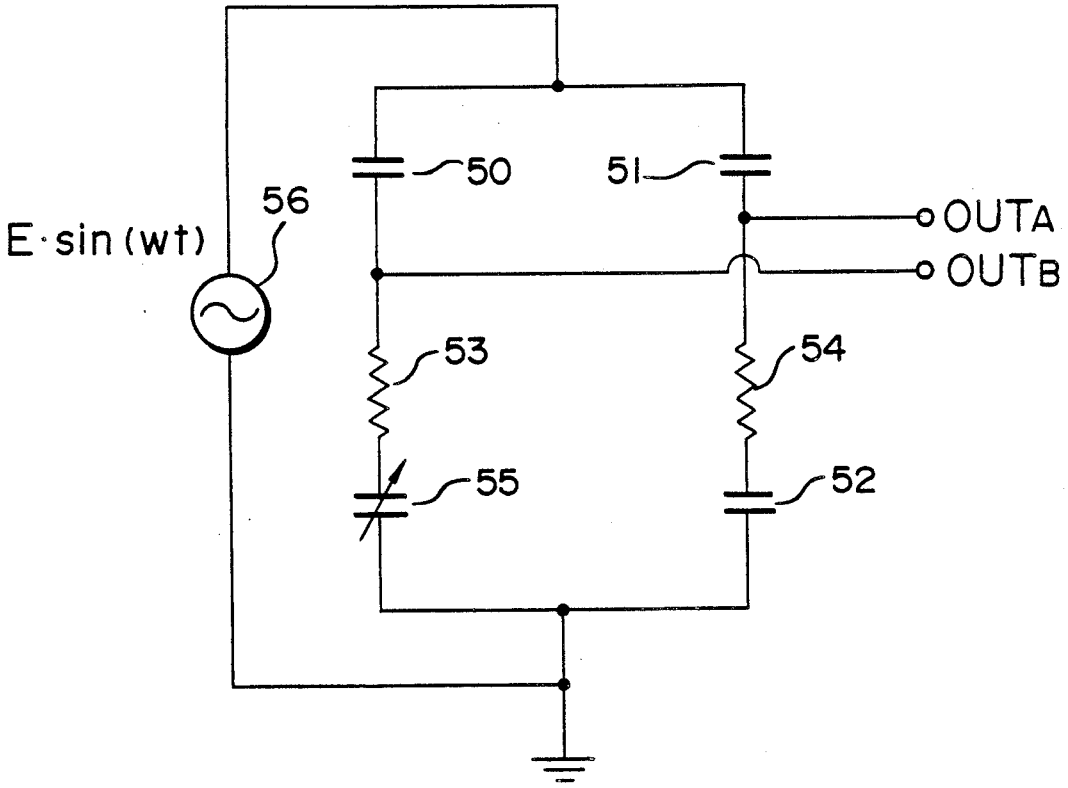
FIG. 3 is a circuit diagram illustrating an example of an electric circuit for realizing a length detector according to the embodiment.

In the Figure, numeral 1 denotes a microprocessor (hereinafter referred to as a "CPU") for controlling the overall system by executing processing in accordance with the flowcharts shown in FIGS. 7 and 8. The program corresponding to these flowcharts is stored in a ROM 1*a*. A RAM 1*b* is used as a work area for the CPU 1. The system further includes a keyboard 2 for setting parameters (e.g. the allowable limits of free length) relating to spring manufacture, a display unit 3 for displaying various graphs based on the parameter settings or the free length of springs measured during spring manufacture, a printer 4 capable of printing out the graphs displayed by the display unit 3, a length detector 5 for detecting the distance between a detector portion 5*a* and the distal end of a spring manufactured by a spring manufacturing mechanism 6, described in detail below. More specifically, the length detector 5 operates by detecting electrostatic capacity and can be realized by the circuit shown in FIG. 3. That is, since electrostatic capacity varies depending upon the distance between the end of a spring and the detector portion 5*a*, the capacitance of a variable capacitor 55 can be made to change correspondingly If the potential at $OUT_A$, $OUT_B$ is detected, the capacitance of the variable capacitor 55 can be calculated, thus making it possible to detect the distance between the detector portion 5*a* and the end of the spring. It should be noted that the charge capacities of capacitors 51, 52 and the resistance values of resistors 53, 54 are known, and that an AC voltage generator 56 generates a voltage of E $\sin\omega t$ ($0 \leqq \omega < \pi$). Accordingly, if the length detector 5 is fixed in advance, it will be possible to detect an amount of variance $_{\Delta}L$ in the desired free length L. It should be noted that the circuit shown in FIG. 3 is meant to serve as an example and that the invention is not limited thereto.

The CPU 1 determines from the free length of a manufactured spring whether the spring is an acceptable item within allowable limits or has a length which is longer or shorter than allowed. A sorter 7 receives from the CPU 1 solenoid drive signals corresponding to the results of the determination and responds by sorting the springs into those that fall within the allowable limits and those that do not.

Figure 4:
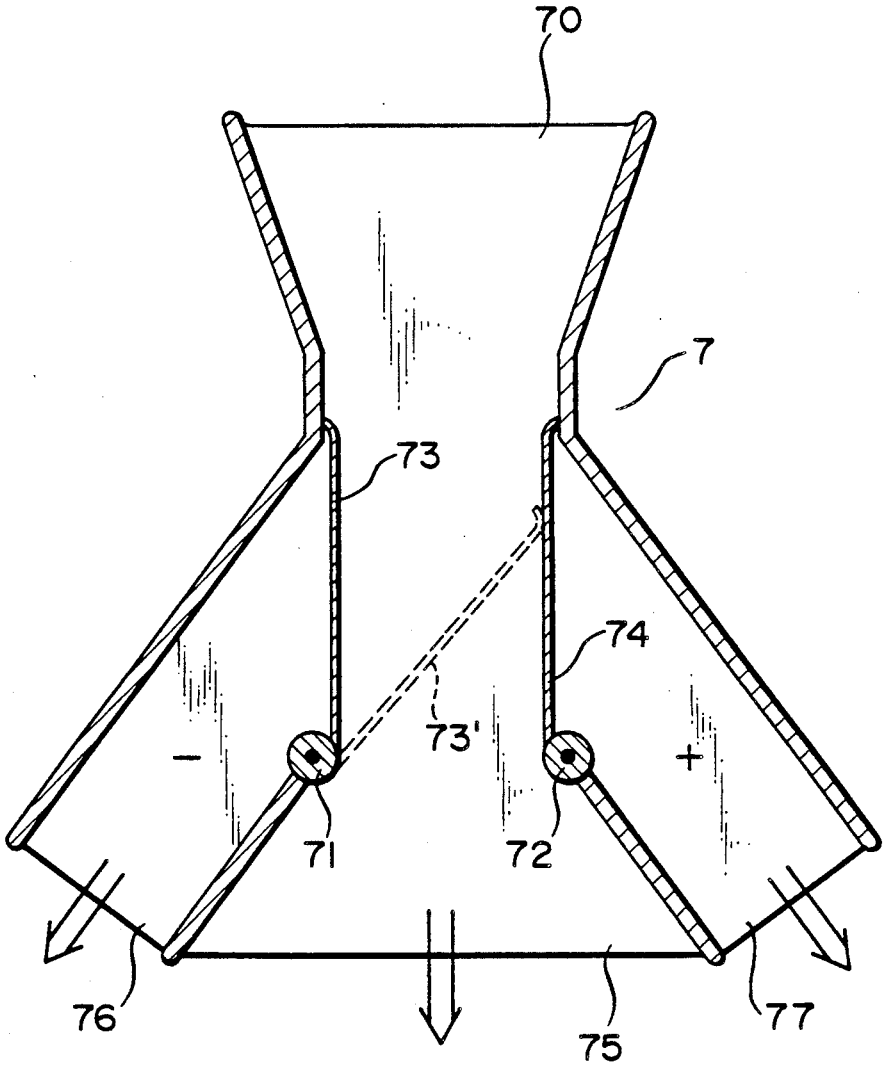
FIG. 4 is a sectional view showing a sorter according to the embodiment.

FIG. 4 illustrates the specific structure of the sorter 7. The sorter 7 includes shutters 73, 74 rotated by respective solenoids 71, 72. When the levels of the solenoid drive signals outputted by the CPU 1 are both "0", both shutters 73, 74 are held in the positions indicated by the solid lines by the action of springs, not shown.

A spring whose free length has been detected by the length detector 5 is severed by a cutter 27 and drops through a common passageway 70. Concurrently, the CPU 1 outputs signals for driving the solenoids 71, 72 based on the detected free length. For example, when it is determined that the free length of a manufactured spring is too short to fall within the allowable limits, the CPU 1 outputs a signal which drives only the solenoid 71, whereupon the shutter 73 is rotated to the state shown by the broken line 73 in FIG. 4, causing the spring which has been dropped into the common passageway 70 to be diverted to a branch passageway 76.

Figure 2A:
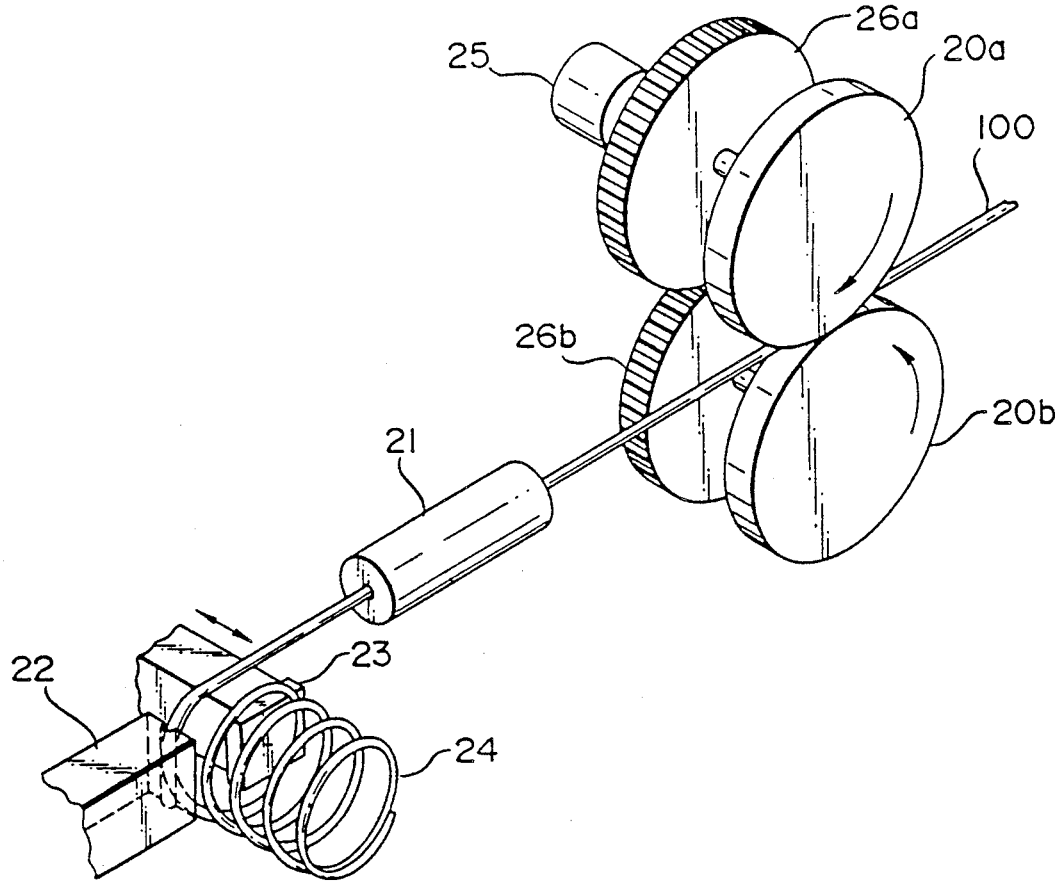
FIGS. 2(A) and 2(B) are views for describing the principle of spring manufacture in the present embodiment.

The construction of the spring manufacturing mechanism 6 and the operating principle thereof will now be described in accordance with FIG. 1 and FIGS. 2(A), (B).

A first gear 26*a* and a first feed roller 20*a* are coaxially supported on the drive shaft of a motor 25. A second gear 26*b* is meshed with the first gear 26*a*. A second feed roller 20*b* is fixed to the second gear 26*b* in coaxial relation therewith. The first and second feed rollers 20*a*, 20*b* clamp a wire 100 between them so that the wire 100 is capable of being fed out toward a point 22 in accordance with the rotation of the rollers 20*a*, 20*b*. Specifically, by rotating the motor 25 in the clockwise direction in FIG. 2(A), the first and second feed rollers 20*a*, 20*b* are caused to rotate in the directions indicated by the arrows, whereby the wire 100 is fed in the direction of the point 22 via a guide 21.

A guide groove is formed in the surface of the point 22 abutted by the end of the wire 100. The groove is inclined in such a manner that the wire 100 that abuts against the groove is forcibly bent downward in FIG. 2(A).

A motor 32 is provided in addition to the motor 25. The motor 32 has a drive shaft which makes one revolution whenever one spring is manufactured and is adapted to form the pitch of the spring. Attached to the drive shaft of the motor 32 is a cam 33 in abutting contact with a driven member 30. As the cam 33 makes one revolution, the driven member 30 makes one round trip in a direction crossing the feed direction of wire 100 while rotation about its axis is limited by a guide 31.

A push rod 29 is screwed into the driven member 30 and is capable of free back-and-forth movement in the axial direction thereof. A pitch tool 23 is mounted on the distal end of the rod 29 in such a manner as to be moved back and forth via a guide 28 without rotating. FIG. 1 shows a small-diameter portion of the cam 33 in abutting contact with driven member 30, in which state the pitch tool 23 is in a position where it will not form a pitch of the spring. As the cam 33 rotates so that the position of the cam contacted by the driven member 30 changes from the small-diameter portion to a large-diameter portion, the pitch tool 23 gradually crosses the travel path of the wire 100 and pushes the portion of the wire coiled by the groove of the point 22, thereby forming the abovementioned pitch. This state is shown in FIGS. 2(A), (B).

Immediately after the wire 100 is bent by the point 22, the wire is severed by a cutter 27 driven in synchronization with one revolution of the motor 32.

Figure 2B:
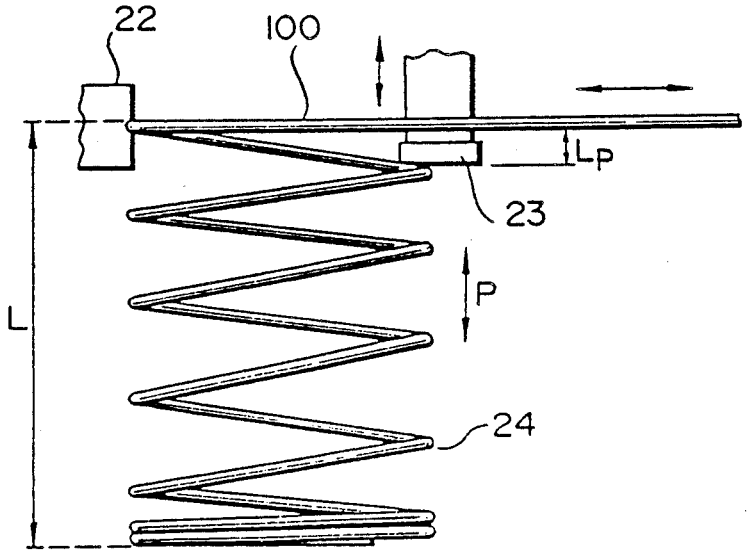

The spring pitch and the free length of the spring, which is decided by the number of coils in the spring, can be predicted depending upon the rotational speed of motor 32 relative to that of motor 25. Nevertheless, springs having exactly the same free length cannot be manufactured. The reason is that even if the pitch tool 23 is thrust forward by an amount $L_P$, as shown in FIG. 2(B), the elasticity of the wire is constantly changing, as a result of which the spring pitch P fluctuates and therefore is not always $2L_P$. Accordingly, it is necessary to finely adjust the amount of thrust $L_P$ of the pitch tool 23 shown in FIG. 2(B). In order to finely adjust the amount of thrust $L_P$ in accordance with the present embodiment, the rod 29 is turned about its axis to change the amount by which the rod 29 is inserted into the driven member 30, thereby finely adjusting the length from the point of contact between the driven member 30 and cam 33 and the distal end of the pitch tool 23.

In order to accomplish this, there are provided, in accordance with the present embodiment, a worm wheel 36, a member 34 engaging the worm wheel 36, and a stepping motor 9 for rotating the worm wheel 36. The relationship among these elements will now be described.

The worm wheel 36, through which the rod 29 is slidably passed and which rotates along with the rod 29, has its axial movement regulated by the engaging member 34. Meshing with the worm wheel 36 is a worm screw 37 supported on the drive shaft of the stepping motor 9. Accordingly, by rotating the drive shaft of the stepping motor 9 a requisite amount in a desired direction, the amount of thrust $L_P$ of the pitch tool 23 described above can be finely adjusted. The stepping motor 9 is driven by a driver 8, and the direction and amount of rotation of the worm wheel 37 are controlled by the CPU 1.

An important consideration is how to determine a control variable for regulating the amount of thrust $L_P$ of the pitch tool 23.

More specifically, when a spring having a length $_\Delta L$ greater than that of the desired free length L is manufactured, a feedback quantity ($=C\times{}_\Delta L$) is calculated in order to reduce the amount of thrust $L_P$ of the pitch tool. The amount of thrust $L_P$ of the pitch tool is finely adjusted by driving the stepping motor 9 by an amount corresponding to the calculated value.

For example, assume that the control variable (feedback ratio) C is 0.01, and that a spring having a length +0.05 mm greater than that of the desired free length L is manufactured. In such case, the feedback quantity will be $5.0\times10^{-4}$. The drive shaft of the stepping motor 9 is rotated by an amount corresponding to this value to shorten the length from the distal end of the pitch tool 23 to the end of the driven member 30. In other words, the amount of thrust $L_P$ of the pitch tool is reduced.

If $_\Delta L$ is negative, the corresponding feedback quantity is calculated in similar fashion to enlarge the amount of thrust of pitch tool 23.

However, since the elasticity of the wire 100 is constantly changing, as described above, it is impossible to determine a value for control variable C conforming to all factors.

In the present embodiment, therefore, statistics are gathered and analyzed in order to decide an optimum value for control variable C before a spring having the desired free length L is manufactured.

The specifics of processing will now be described.

First, N-number of springs are manufactured using a function of a control variable Co as an initial value. This will be referred to as "sampling manufacture" hereinafter. Differences between desired free lengths sensed during sampling manufacture are stored successively in the RAM 1*b*. During this operation the sorter 7 is being driven in accordance with the sensed free lengths of the springs so that acceptable springs produced by sampling manufacture will not be wasted.

During or after a first sampling manufacturing operation, an acceptance rate G based on a number n of springs within allowable limits, an average value $_{66}L$ of differences relative to the desired free length, and a standard deviation value $\pi$ thereof are calculated. It should be noted that an average length $\bar{L}$ may be used instead of the average value $_\Delta L$.

The aforementioned values are calculated in accordance with the following equations:

$$G = n/N$$

$$\Delta L = \frac{\sum_{j=1}^{N} \Delta Lj}{N}$$

-continued $$\sigma = \left\{ 1/N \cdot \sum_{j=1}^{N} (\Delta L - \Delta Lj)^2 \right\}^{\frac{1}{2}}$$

where j represents the number of springs produced during a sampling manufacturing operation.

A control variable value Ci relating to a sampling manufacturing operations from the second onward (i.e. an i-th sampling manufacturing operation) is a value [$=Co+{}_\Delta C\times(i-1)$] obtained by adding $_\Delta C$ to the control variable of the immediately preceding sampling manufacturing operation, and the three values mentioned above are calculated for each operation. When these sampling manufacturing operations have been executed a preset m-number of times, it is determined which sampling manufacture, namely the sampling manufacture using which value of the control variable, gives the best results.

Criteria are used to decide the optimum value of the control variable. In the present embodiment, this is determined by carrying out weighting as follows with regard to each factor:

acceptance rate > average value > standard deviation

That is, when the maximum acceptance rate is obtained at the time of an i-th sampling manufacturing operation among m sampling manufacturing operations, the value of $Co+{}_\Delta C\times(i-1)$ is decided on as the optimum control variable. If there are-two or more candidates for the optimum acceptance rate, the decision is made based on the second criterion, namely the "average value". If the candidates cannot be limited to one using the average value, then the decision is made based on the third criterion, namely the "standard deviation".

In the present embodiment, the number m of sampling manufacturing operations and the number N of springs manufactured in each sampling manufacturing operation are specified. However, since the statistics collected will lose their meaning if these values are too small, it is necessary that m and N be somewhat large. Specifically, m should have a value of several tens, and N should have a value of several hundred. The setting of the initial control variable Co and of the add-on value $_\Delta C$ in each sampling manufacturing operation is also important. When a spring having a comparatively large free length is manufactured, m should be large and $_\Delta C$ should be small. The reason is that though the feedback quantity is decided by the control value, variance is large in comparison with manufacture of a spring having a small free length and it is therefore necessary to perform a detailed analysis.

The reasons for establishing a preferential order regarding the abovementioned factors will now be described in accordance with FIGS. 5 and 6. The description that follows is a method of deciding the optimum value for the control variable based on a distribution of differences relative to a desired free length. However, the same would hold using a distribution of free lengths of manufactured springs.

Assume that n springs are to be manufactured as samples, with the free length being 50.00 mm and the allowable limits being ±0.08 mm. Differences with respect to 50.00 mm are plotted along the vertical axis, and frequency is plotted along the horizontal axis to obtain the graphs shown in FIGS. 5(A) and 5(B). It is assumed that the acceptance rates are the same in these views. Naturally, the values for the control variable in the two graphs differ.

Figure 5A:
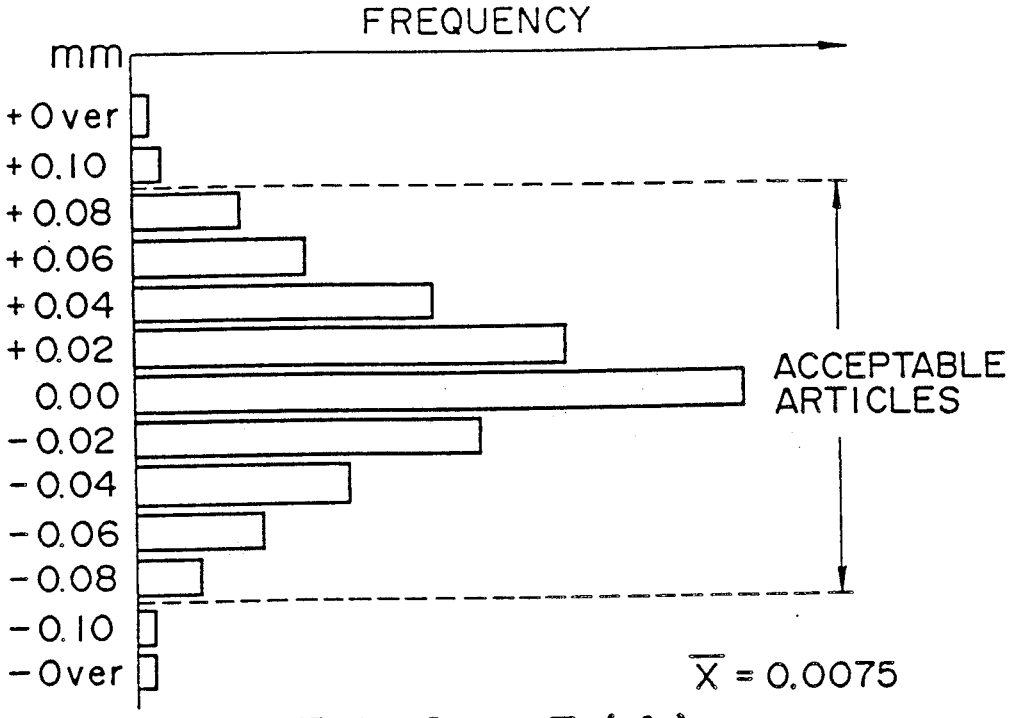
FIGS. 5(A), (B) and FIGS. 6(A), (B) are graphs showing the relationship between dispersion and the frequency thereof at the time of spring manufacture when a control variable according to the embodiment is varied.
Figure 5B:
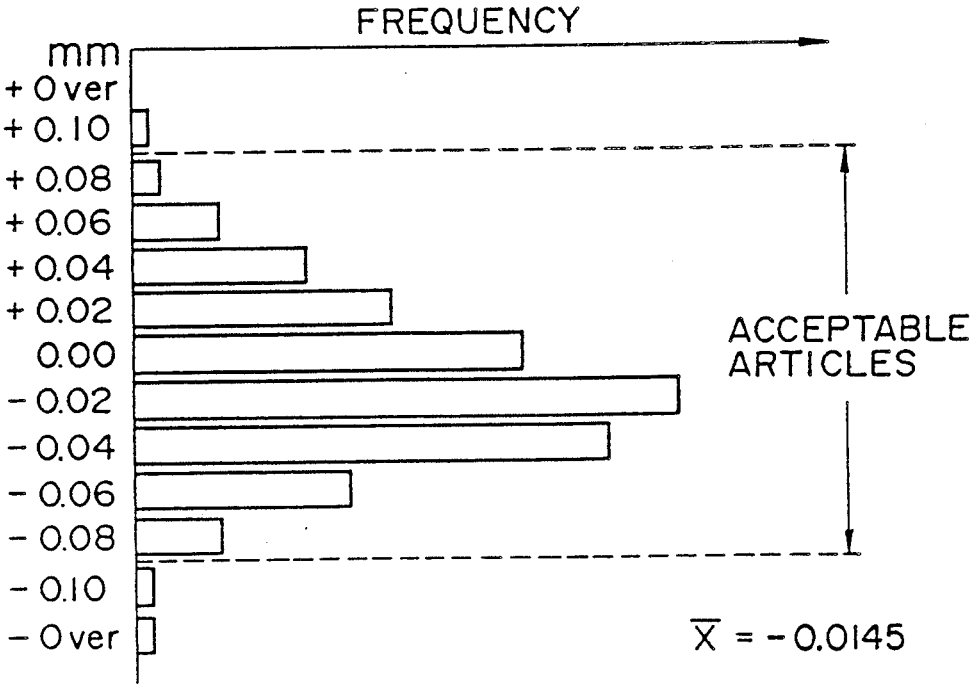

Whereas the average differential with respect to the desired free length of the spring is about 0.008 mm in FIG. 5(A), the average differential is −0.0145 mm in FIG. 5(B). Obviously, the control variable relating to the sampling manufacture of FIG. 5(A) has the higher priority. Accordingly, upon predicting a case where the acceptance rates will be the same, the importance of the average value as the second criterion can be understood. In other words, one criterion is whether it is possible to manufacture springs having a higher precision by reducing the allowable limits (e.g. to ±0.04 mm).

If a case is predicted where the average values will be the same as well as the acceptance rates, then a determination is made using the third criterion, namely the standard deviation $\sigma$(or deviation $\sigma^2$).

Figure 6A:
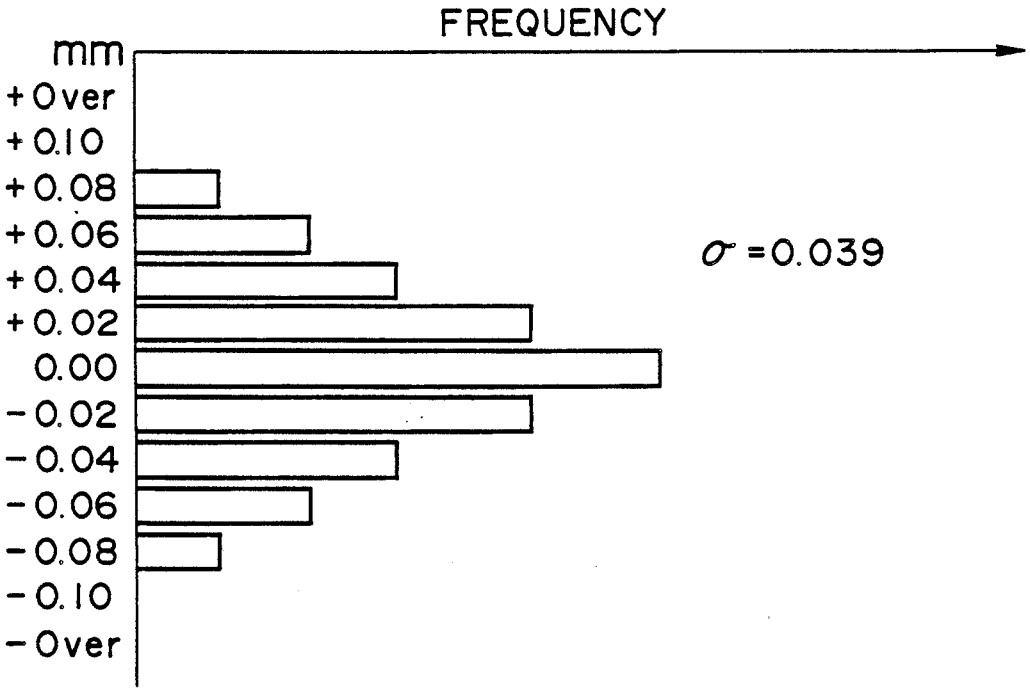
Figure 6B:
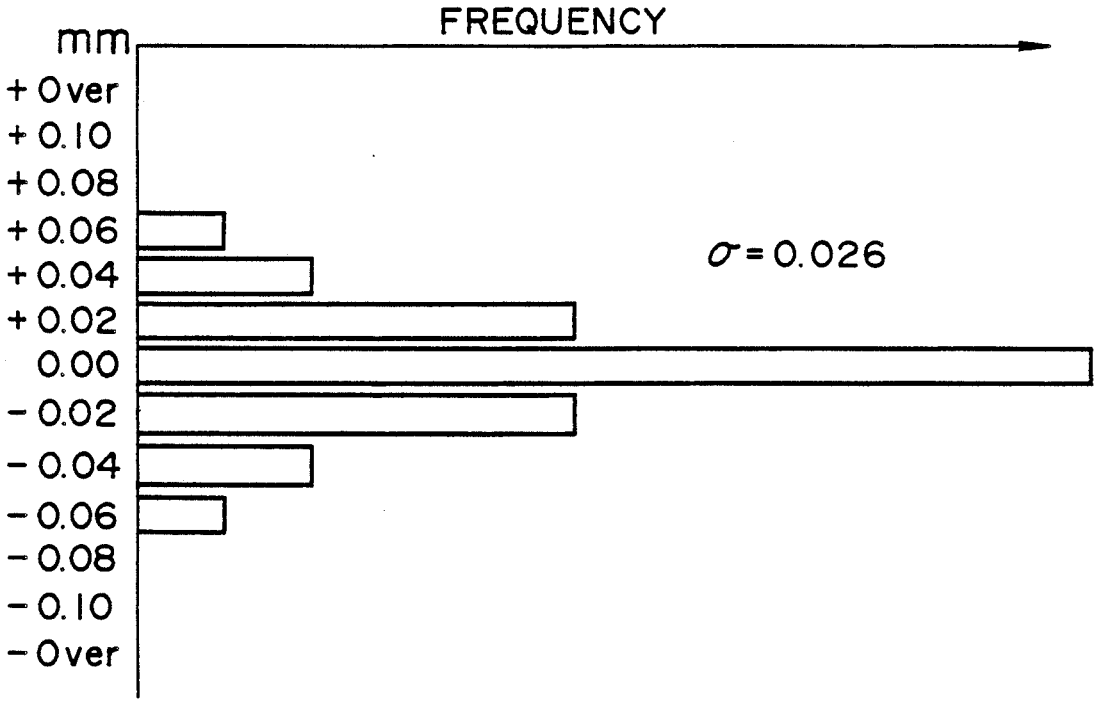

FIGS. 6(A), 6(B) illustrate a case where the acceptance rates are the same and the errors with respect to the desired free length are both 0.00 mm. Obviously, the higher the frequency where the error is 0.00 mm (i.e. the smaller the standard deviation), the better. It can therefore be understood that the sampling manufacture having the control variable of FIG. 6(B) (i.e. where the standard deviation $\sigma$ is about 0.026) has a higher priority than that having the control variable of FIG. 6(A) (where the standard deviation $\sigma$ is about 0.039). In particular, in the case of FIG. 6(B), the fact that the standard deviation is small suggests that the allowable limits on the spring free length can be reduced further.

Displaying the foregoing graphs and a time-series transition of the three values serving as criteria on the display unit 3 will make it very easy for an operator to grasp the existing circumstances.

Figure 7A:
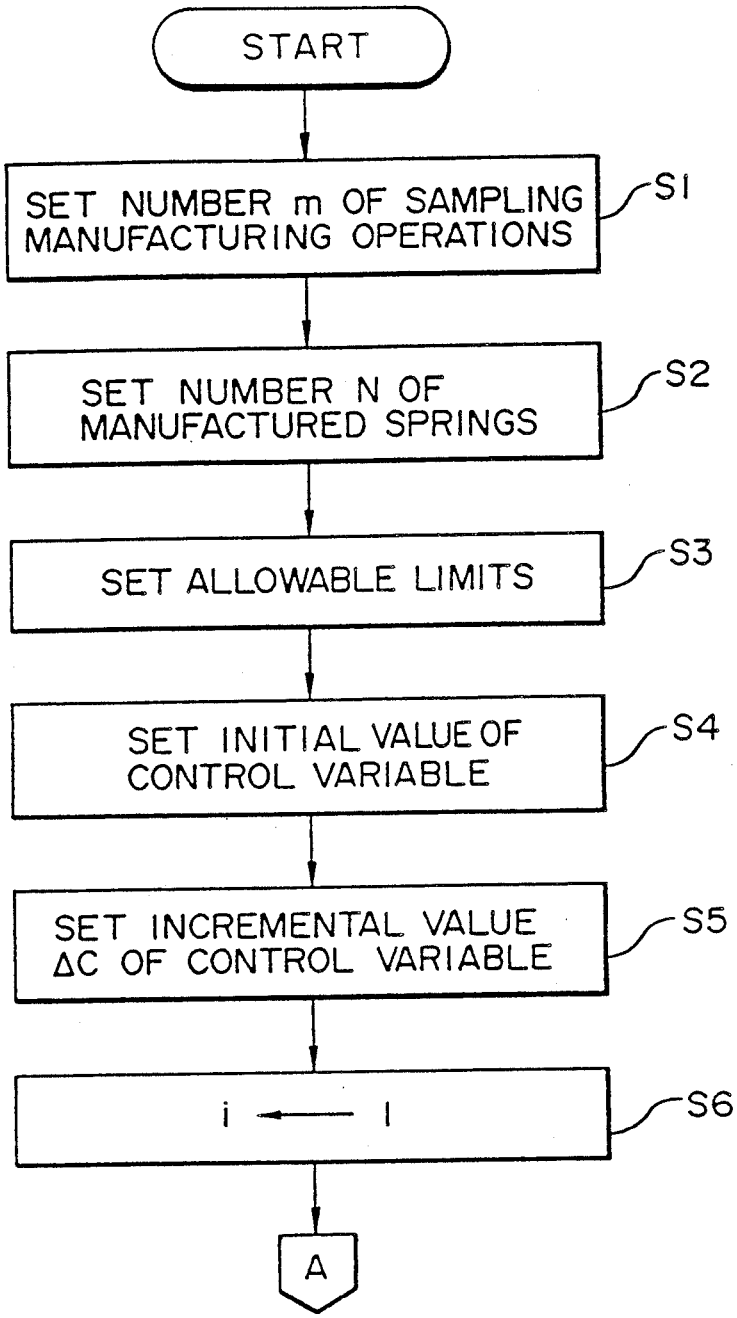
FIGS. 7(A), (B) are flowcharts illustrating processing executed by a CPU in the embodiment.
Figure 7B:
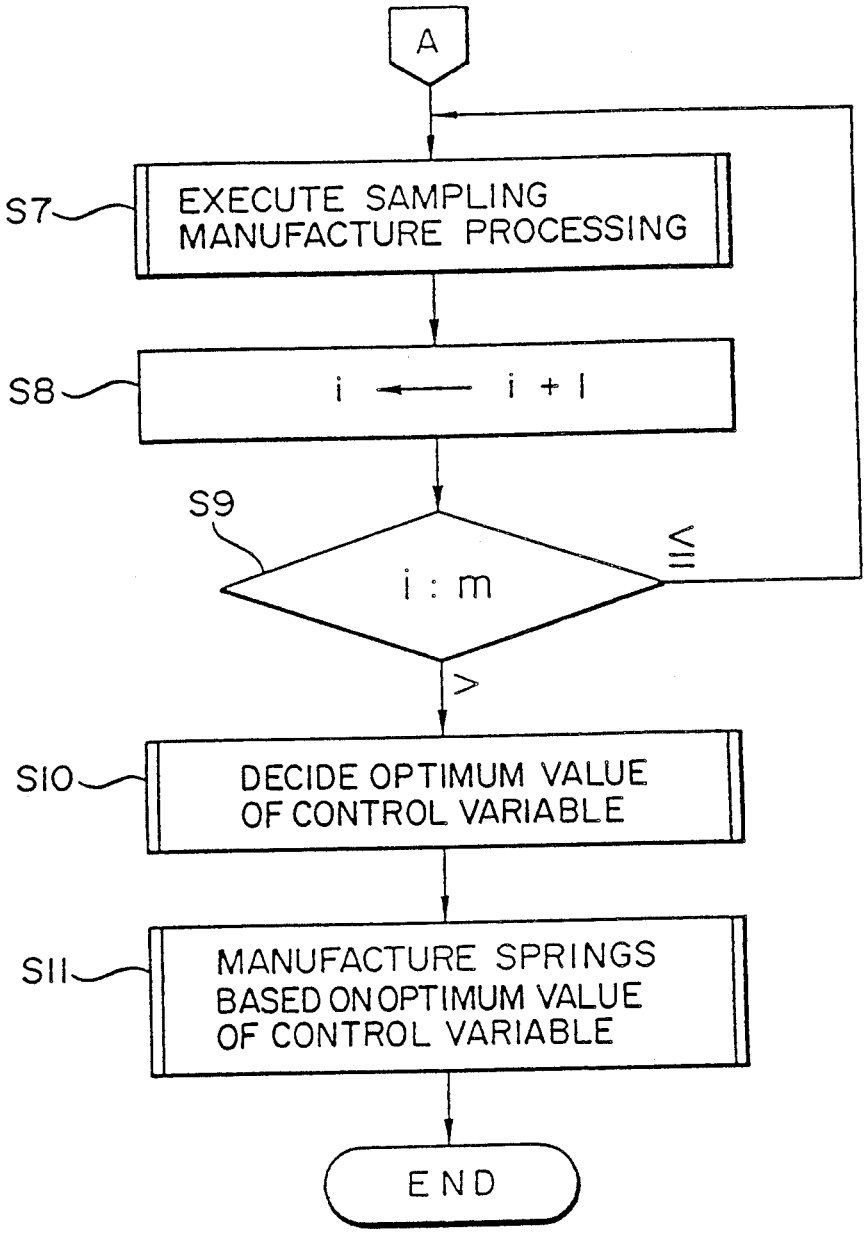

The flowcharts of FIGS. 7(A) and 7(B) summarize processing according to the present embodiment based on the above-described arrangement and principle.

First, the number m of sampling manufacturing operations is set from the keyboard 2 at a step S1 of the flowchart. Next, the number N of springs produced by each sampling manufacturing operation is set at a step S2, the allowable limits are set at a step S3, the initial control variable value Co is set as a step S4, and an incremental value $_\Delta$C of the control variable value is set at a step S5. This is followed by a step S6, at which "1" is substituted into the variable i as the initial value. It should be noted that whether or not sampling manufacture has ended is determined based on the value of the variable i.

Step S7 in FIG. 7(B) calls for sampling manufacturing processing to be executed. When a single sampling manufacturing operation ends, the variable is incremented at a step S8 and the variable i is compared with the number m of sampling manufacturing operations at a step S9. If the decision rendered at the step S9 is that $i \leqq m$ holds, then the program returns to the step S7 to execute the next sampling manufacturing operation. The steps S7 through S9 are repeated until the relation $i > m$ is established.

When it is determined at the step S9 that $i > m$ holds, the program proceeds to a step S10, at which the optimum value of the control variable is decided in accordance with the criteria already described. Spring manufacture is executed at a step S11 based on the optimum control variable obtained. This processing is executed until the preset number of acceptable springs is attained, or until the apparatus stops.

Figure 8A:
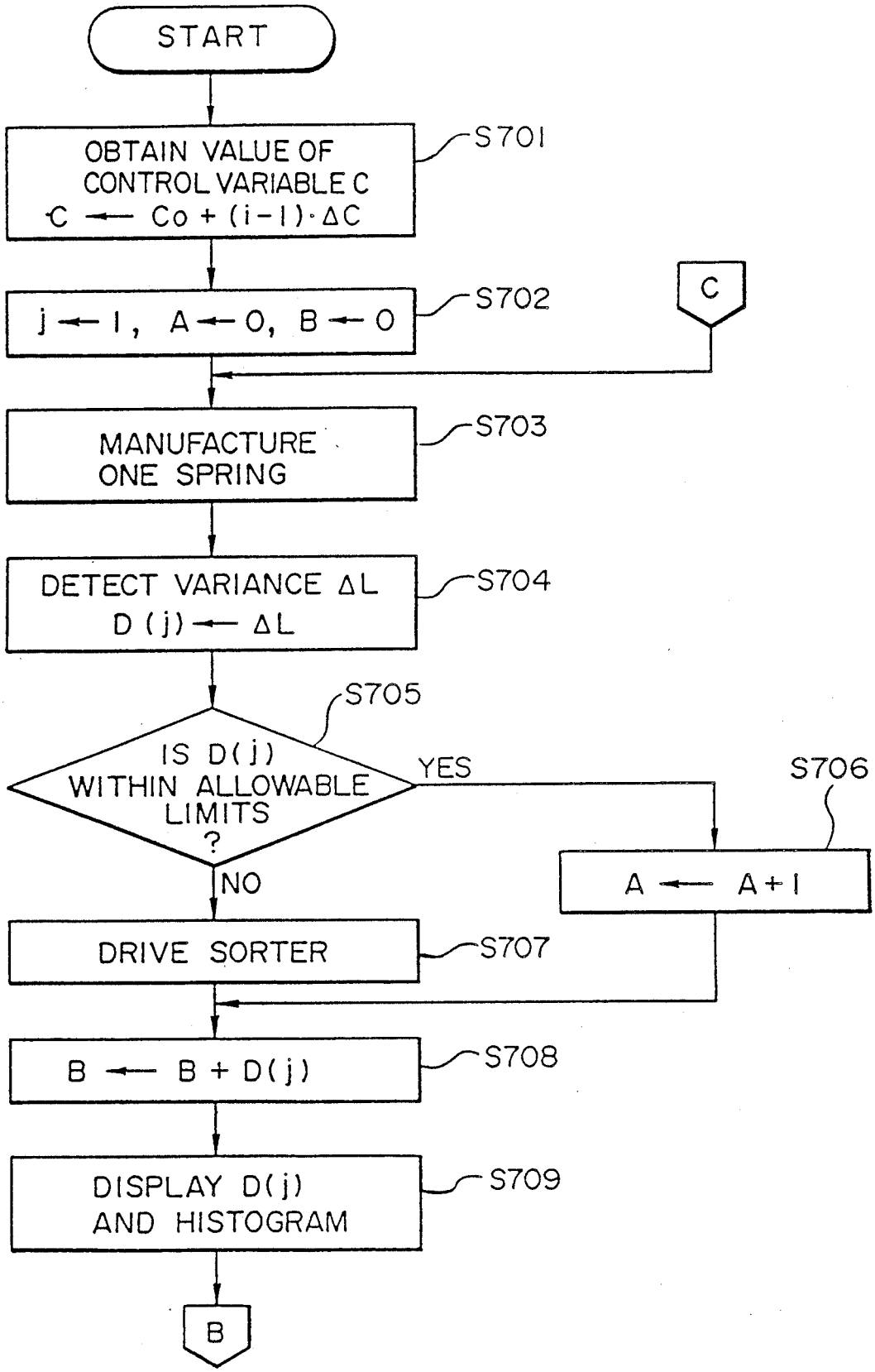
FIGS. 8(A), (B) flowcharts illustrating processing executed by the CPU when manufacturing samples according to the embodiment.

The details of sampling manufacture processing executed at the step S7 will now be described in accordance with FIGS. 8(A) and 8(B).

A step S701 calls for the value of control variable C for sampling manufacture to be obtained in accordance with the following equation based on the variable i indicating the order of the sampling manufacturing operation:

$$\text{control variable } C = Co + (i-1) \times {}_\Delta C$$

Accordingly, the control variable at the time of the first sampling manufacturing operation is the preset value Co.

Next, "1" is substituted into the variable j representing the number of springs produced during the sampling manufacturing operation, a variable A representing the number of acceptable springs is initialized to "0", and a variable B representing the sum total of variance is also initialized to "0". At the conclusion of these initial settings, the program proceeds to a step S703 to actually manufacture one spring. This is followed by a step S704, at which the variance $_\Delta$L with respect to the desired free length detected by the length detector is detected and temporarily stored as a variable D(j). It is then determined at a step S705 whether the variance D(j) falls within the allowable limits. If the answer is YES, then "1" is added to the variable A at a step S706 and the program proceeds to a step S708. If the answer obtained at step S705 is NO, indicating that the variance D(j) is outside the allowable limits, the program proceeds to a step S707, at which the solenoid 71 or 72 of the sorter 7 is driven for a predetermined period of time. Which solenoid is driven depends upon the sign of the variance. This is followed by the step S708.

The step S708 calls for the variance D(j) to be added to the variable B, after which the value of D(j) and the graphs described above are displayed at a step S709.

Figure 8B:
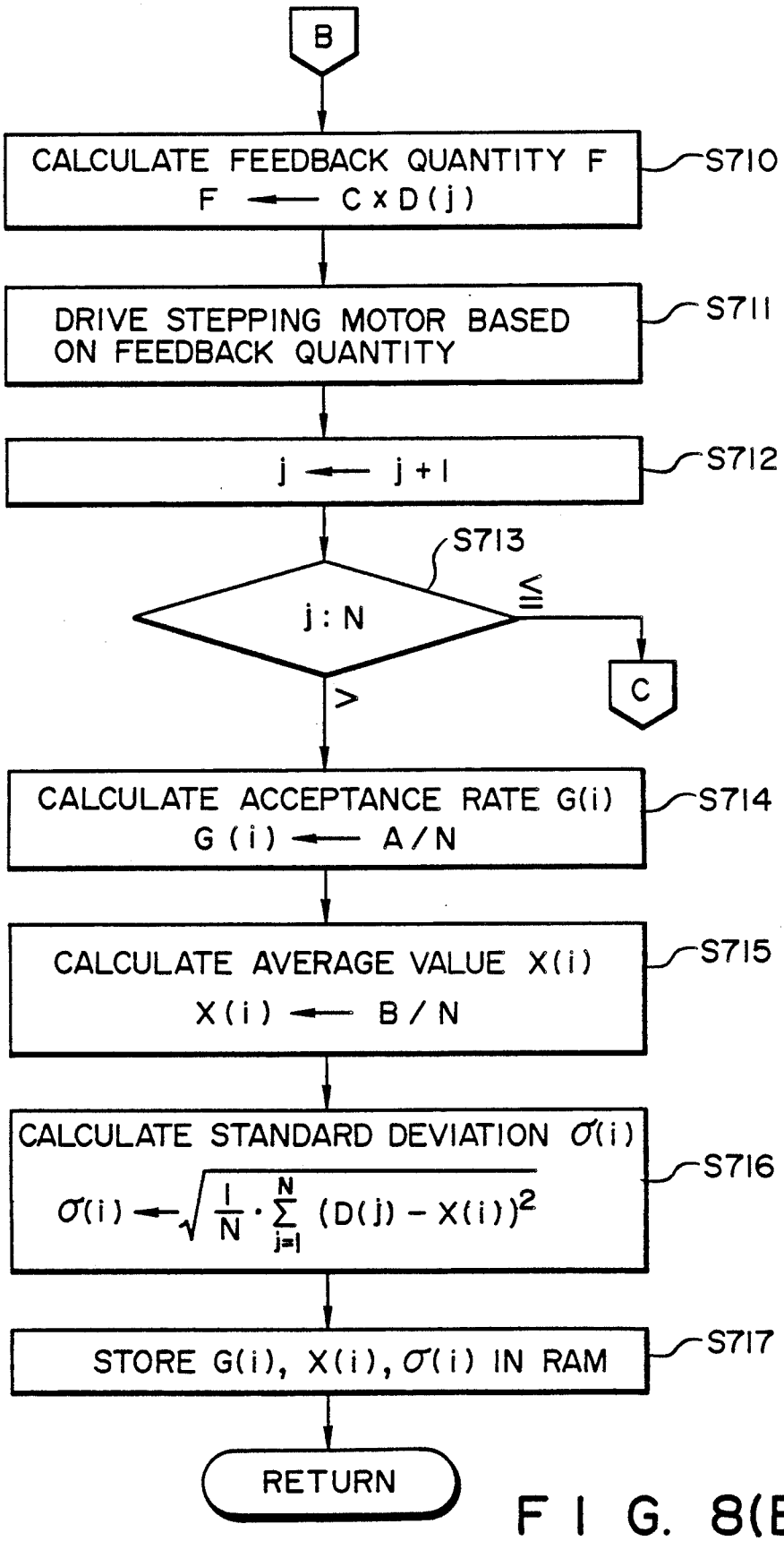

Next, a feedback quantity F is calculated at a step S710 [FIG. 8(B)]. Though the function for calculating the feedback quantity has already been described, it may be expressed by the following equation:

$$F = C \times D(j)$$

The stepping motor 9 is driven at a step S711 based on the magnitude and sign of the feedback quantity F obtained. This is followed by a step S712, at which the variable j is incremented by 1, and by a step S713, at which the variable j and set value N are compared. If it is determined that $j \leqq N$ holds, this means that N springs have not yet been manufactured, and the program returns to the step S703. When N springs have been manufactured, the determination $j > N$ is made at the step S713 and processing is executed from a step S714 onward. Accordingly, the number of springs which fall within the allowable limits is stored as the variable A at this time. In addition, the sum total value of the variances of the N springs is stored as the variable B, and the variances of the individual springs are stored as variables D(1) through D(N).

Based on these values, an acceptance rate G(i), average value X(i) and standard deviation $\sigma$(i) for the i-th sampling manufacturing operation are calculated at steps S714 through S716. The values obtained are stored in the RAM 1*b* at a step S717.

By executing the foregoing processing for each single sampling manufacture, there are obtained an acceptance rate, average value and standard deviation peculiar to each sampling manufacture. The optimum control variable value may thus be decided at the above-described step S10 in accordance with the variables G(i), X(i) and $\sigma$(i) obtained.

In accordance with the present embodiment as described above, the optimum conditions relating to spring manufacture are sensed prior to the spring manufacturing stage, thereby making it possible to manufacture springs under conditions for the optimum acceptance rate. Furthermore, since a series of processing steps is executed automatically, it is possible even for an operator with little spring manufacturing experience to reliably manufacture springs having the desired free length.

When one reel of the wire is used up and a new reel of the wire is set in place, or when springs having a different length are to be produced in the course of a manufacturing operation, executing the same preprocessing is desirable. The reason for this is that there is a slight change in material quality, diameter and the like when there is a difference in the lot of the wire.

In the present embodiment, acceptance rate is calculated by a count-up operation when manufactured springs fall within the allowable range. However, it is mathematically possible to calculate the acceptance rate when allowable limits are set based on the standard deviation value. The standard deviation value is calculated by the above-discussed equations. This means that it is unnecessary to count the springs within the allowable range one at a time. In other words, the optimum control variable can be decided based solely on a distribution of free lengths during each sampling manufacturing operation.

In the present embodiment, the feedback quantity is calculated on each occasion based on the function. However, feedback quantities can be stored as a table in the ROM 1*a* and read out as needed.

Figure 9:
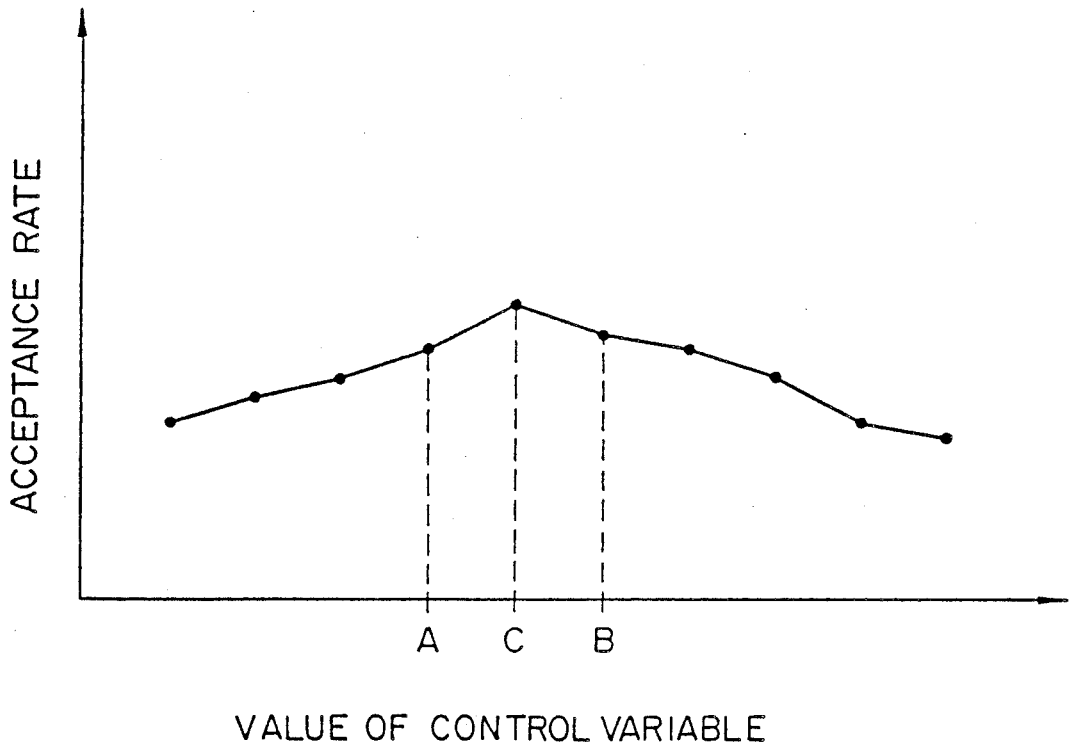
FIG. 9 is a view illustrating an example of the relationship between acceptance rate and sampling manufacture according to the embodiment.

If a graph showing the relation of the kind illustrated, for example, in FIG. 9 is obtained when the number of sampling manufacturing operations is plotted along the horizontal axis and the acceptance rate along the longitudinal axis, it can be arranged so that subsequent sampling manufacture is suspended to prevent inadvertent waste of the wire. However, since the determination as to whether or not the acceptance rate has peaked cannot be made unless the acceptance rate of the next sampling (point B) is measured, the actual number of samplings necessary will be the number of samplings up to the moment the maximum acceptance rate is detected plus one additional sampling.

If the maximum acceptance rate is obtained at the point C in FIG. 9, it is judged that a setting for the maximum acceptance rate resides between points A and B on either side of the point C. Accordingly, if the sampling state (point A in FIG. 9) immediately preceding the sampling at which the maximum acceptance rate is detected is returned to, $_{\Delta}C'$ (where $_{\Delta}C' < {}_{\Delta}C$) is adopted as the incremental value and the flowcharts of FIGS. 7 and 8 are executed up to the point B, a spring manufacturing environment for an even better acceptance rate can be sensed.

In the illustrated embodiment, only control of the pitch tool 23 is described. However, since the position of the point 22, by way of example, also has a significant influence upon the free length of springs, it can be arranged so that the position of the point is finely adjusted. Analysis processing may then be carried out as before.

Further, in illustrated embodiment, a motor for feeding the wire and a motor for making a pitch are independently provided. However, the present invention is not limited to such a construction, for example, a common motor for feeding the wire and for making a pitch may be used.

ADVANTAGES OF THE INVENTION

In accordance with the spring manufacturing method of the present invention as described above, springs having a desired free length can be mass produced. In accordance with the spring manufacturing apparatus of the invention, springs having a desired free length can be mass produced through a simple operation.

As many apparently widely different embodiments of the present invention can be made without departing from the spirit and scope thereof, it is to be understood that the invention is not limited to the specific embodiments thereof except as defined in the appended claims.

What is claim is:

1. A spring manufacturing system for producing springs having a desired free length, comprising:

feeding means for feeding a wire;

a coiling point means situated in the direction of feed for being contacted by the wire to forcibly bend the wire in a predetermine direction;

a pitch tool means reciprocating in a direction substantially perpendicular to a plane in which the wire is being bent for thrusting into contact with the wire by a set amount of thrusting motion such as to form a coil pitch in the wire, related to said desired free length, as the wire is being bent continuously by said coiling point means, said pitch tool means including a rod having at its one end a pitch tool adapted to engage said wire, and at its other end means to reciprocate said rod along said direction;

severing means for severing the wire in synchronization with the reciprocating motion of said pitch tool means;

means for selectively setting a control variable to one of a plurality of values, and generating a predetermined control signal related to the value of the control variable;

detecting means for detecting, for a particular spring, the amount of difference between an actual free length of a manufactured spring and the desired free length, and for generating a difference signal related thereto;

means for combining said predetermined control signal and said difference signal corresponding to said particular spring to generate a feedback signal;

manufacturing means for (a) manufacturing springs in a plurality of pre-manufacturing operation involving respectively producing a predetermined number of springs for each of said plurality of values of said control variable, and (b) thereafter manufacturing springs in a manufacturing operation based on an optimum value of said control variable obtained by said pre-manufacturing operation, said manufacturing means including adjusting means for adjusting a set amount of thrusting motion of said pitch tool means in accordance with said feedback signal, said adjusting measn including means to vary the length of said rod extending between said pitch tool and said reciprocating means to vary the distance therebetween for manufacturing a subsequent spring; and analyzing measn responsive to said difference signal for identifying said optimum value of said control variable in accordance with a distribution of actual free lengths of the springs manufactured by said pre-manufacturing operation on the basis of each of said plurality of values of said control variable, and for providing said optimum value of the control variable to said manufacturing means for use in said manufacturing operation.

2. The system of claim 1, wherein for an i-th pre-manufacturing operation, the combining means generates a feedback signal fi defined by $$fi = C_i \times \Delta L$$

where L is said amount of difference, and $C_i$ is the selected value of the control variable as defined by $$C_i = C_o \times \Delta C \times (i-1)$$

with $C_o$ being an initial value of the control variable, and $\Delta C$ being a given incremental value of the control variable.

3. The system of claim 2, wherein said setting means comprises first means for setting the values of $C_o$ and $\Delta C$, and second means for setting a number of springs manufactured in said plurality of pre-manufacturing operations, and a number of such pre-manufacturing operations.

4. The system according to claim 1, wherein said analyzing means identifies said optimum value of the control variable by calculating, for each of said pre-manufacturing operations, an acceptance rate, an average value of amounts of difference and a standard deviation value of said amounts of difference from a distribution of amounts of difference between actual free lengths and desired free lengths of spring manufactured in each of said pre-manufacturing operations.

5. The system according to claim 1, wherein said analyzing means identifies said optimum value of the control variable by calculating, for each of said pre-manufacturing operations, an acceptance rate, an average free length and a standard deviation value of free lengths from a distribution of actual free lengths of springs manufactured in each of said pre-manufacturing operations.

6. The system according to claim 1, further comprising display means for displaying a graph based on the free lengths of springs manufactured in each of said manufacturing operations.

7. The system according to claim 1, wherein said rod length varying means comprises a screw type coupling means between the other rod end and the reciprocating means, and means to turn the rod about its axis relative to said reciprocating means.

8. The system according to claim 7, wherein said turning means comprises a worm wheel, a worm screw, means for coupling while permitting sliding of said rod in said direction relative to said worm wheel, and means for coupling said worm screw to the worm wheel to rotate said worm wheel about the rod axis while maintaining said worm wheel stationary along said direction.

* * * * *